US010890037B2

(12) United States Patent
Clarke et al.

(10) Patent No.: US 10,890,037 B2
(45) **Date of Patent: *Jan. 12, 2021**

(54) SLIPS POSITIONING APPARATUS FOR A WELL OPERATION

(71) Applicant: PROSTAR ENERGY TECHNOLOGIES (USA) LLC, Leduc (CA)

(72) Inventors: Jason Peter Clarke, Calgary (CA); Daniel John Clarke, Calgary (CA)

(73) Assignee: PROSTAR ENERGY TECHNOLOGIES (USA) LLC

( * ) Notice: Subject to any disclaimer, the term of this patent is extended or adjusted under 35 U.S.C. 154(b) by 0 days.

This patent is subject to a terminal disclaimer.

(21) Appl. No.: 16/383,636

(22) Filed: Apr. 14, 2019

(65) Prior Publication Data

US 2019/0234156 A1 Aug. 1, 2019

Related U.S. Application Data

(63) Continuation of application No. 15/452,600, filed on Mar. 7, 2017, now Pat. No. 10,323,472.

(60) Provisional application No. 62/406,814, filed on Oct. 11, 2016.

(51) Int. Cl.
*E21B 19/10* (2006.01)
*E21B 33/06* (2006.01)

(52) U.S. Cl.
CPC ..... *E21B 19/10* (2013.01); *E21B 33/06* (2013.01)

(58) Field of Classification Search
CPC ..... E21B 19/10; E21B 33/06
USPC ..... 166/379
See application file for complete search history.

(56) References Cited

U.S. PATENT DOCUMENTS

2013/0255446 A1 10/2013 Taggart
2014/0138080 A1 5/2014 Yorga et al.
2015/0101826 A1 4/2015 Gupta et al.

*Primary Examiner* — Taras P Bemko
(74) *Attorney, Agent, or Firm* — Jason P. Webb; Pearson Butler

(57) ABSTRACT

A slips positioning apparatus for a wellhead installation is installed in a fixed position relative to the blow out preventer and allows releasable locking of the slips relative to well center and driving movement of the slips relative to well center. The slips positioning apparatus includes a slips-mounting structure for accepting connection of the slips; an installation structure for mounting the apparatus rigidly above the blow out preventer and relative to well center. The installation structure is a plate that defines a first plane. The apparatus further includes a first and a second linear guides configured for movement of the slips-mounting structure relative to the installation structure along respective first and second directions in planes substantially parallel with the first plane; and first and second linear actuators for moving the slips-mounting structure respectively along the first and second linear guides. Slips are mounted on the slips-mounting structure and positioned, including releasably locked and/or driven, by the apparatus relative to well center.

12 Claims, 4 Drawing Sheets

SLIPS POSITIONING APPARATUS FOR A WELL OPERATION

CROSS-REFERENCE TO RELATED APPLICATIONS

This application is a Continuation Application of, under 35 U.S.C. § 120, and claims priority to, under 35 U.S.C. § 120, U.S. Non-Provisional application Ser. No. 15/452,600, entitled SLIPS POSITIONING APPARATUS FOR A WELL OPERATION by Jason Peter Clarke, filed on Mar. 7, 2017. This invention claims priority therethrough, under 35 U.S.C. § 120, to the U.S. Provisional Patent Application No. 62/406,814 to Jason Peter Clarke, filed on Oct. 11, 2016 which is incorporated by reference herein.

BACKGROUND OF THE INVENTION

Field of the Invention

The invention relates to a well operation apparatus and in particular a wellhead apparatus for positioning the slips in a well operation.

Background

Wellbore operations employ pipe strings, sometimes called drill, production or work strings, each used for drilling and/or servicing. The pipe string can comprise a bottom hole assembly such as, when drilling, a drill bit attached to sections of drill pipe. As the well is drilled or serviced, additional sections of drill pipe are added to the pipe string to extend its length until the bottom hole assembly is deep enough to reach a depth of interest. Sections of pipe are joined together using threaded connections on the pipe, often referred to as "pin" and "box" connections, where the pin of one section of pipe is threaded into the box of an adjoining section of pipe. When the pipe string is removed from the wellbore, the sections of pipe can be removed from the pipe string by unthreading the connections and setting aside a pipe section.

While servicing or drilling wells, a BOP (blowout preventer) is installed on the wellhead. The purpose of the BOP is to close off the well in the event of an emergency and to seal the well while normal servicing or drilling operations are being conducted. To prevent the drill string from falling into the well, a device called "slips" are employed. The slips are a mechanical device with a set of jaws that allow the drill string to be moved up out of the well, with the slips acting to arrest automatically the drill string if it starts falling into the well. The slips can be unlocked to allow controlled movement of the drill string into the well, when desired.

Currently, the slips are positioned atop the BOP and are free to slide around relative to the BOP. This allows the driller to move the drill string with respect to the well casing and slips will slide to follow the string. It is desirable to move the drill string with respect to the well casing because often it is a requirement for multiple strings to be positioned in the well side by side and, so, the string to be controlled is off center.

However, the slips, being free to slide, are difficult to use in a slant rig. The slant orientation may tend to pull the slips to the low side. In addition, since the movement of the slips cannot currently be controlled, it is difficult to move and hold the slips in a position suitable to locate the drill string, as desired by the driller. Because of this, dangerous, time consuming and inefficient methods may be employed to move the slips and the drill string to the desired location and to counteract gravitational issues when operating in slant.

SUMMARY OF THE INVENTION

In accordance with a broad aspect of the present invention, there is provided a method for positioning a slips relative to a well center of a wellbore, the method comprising: operating a slips positioning apparatus including: a slips-mounting structure for accepting connection of the slips; an installation structure for mounting the apparatus rigidly relative to well center, the installation structure having an upper surface defining a first plane; a first linear guide configured for movement of the slips-mounting structure relative to the installation structure along a first direction in a plane substantially parallel with the first plane; a second linear guide configured for movement of the slips-mounting structure relative to the installation structure along a second direction in a plane substantially parallel with the first plane; a first linear actuator for moving the slips-mounting structure along the first linear guide; and, a second linear actuator for moving the slips-mounting structure along the second guide; and actuating the first linear actuator to position the slips along the first direction.

In accordance with another broad aspect of the present invention, there is provided a wellhead installation comprising: a blowout preventer; a slips positioning apparatus installed in a fixed position relative to the blow out preventer, the slips positioning apparatus comprising: a slips-mounting structure for accepting connection of the slips; an installation structure for mounting the apparatus rigidly relative to well center, the installation structure having an upper surface defining a first plane; a first linear guide configured for movement of the slips-mounting structure relative to the installation structure along a first direction in a plane substantially parallel with the first plane; a second linear guide configured for movement of the slips-mounting structure relative to the installation structure along a second direction in a plane substantially parallel with the first plane; a first linear actuator for moving the slips-mounting structure along the first linear guide; and a second linear actuator for moving the slips-mounting structure along the second guide; and slips mounted on the slips-mounting structure.

In accordance with another broad aspect of the present invention, there is provided a slips positioning apparatus for installing slips relative to well center, the slips positioning apparatus comprising: a slips-mounting structure for accepting connection of the slips; an installation structure for mounting the apparatus rigidly relative to well center, the installation structure having an upper surface defining a first plane; a first linear guide configured for movement of the slips-mounting structure relative to the installation structure along a first direction in a plane substantially parallel with the first plane; a second linear guide configured for movement of the slips-mounting structure relative to the installation structure along a second direction in a plane substantially parallel with the first plane; a first linear actuator for positioning the slips-mounting structure along the first linear guide; and, a second linear actuator for positioning the slips-mounting structure along the second guide.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for providing a comprehensive understanding of the present invention. However, it will be apparent to those skilled in the art that the present invention may be practiced without these specific details.

A slips positioning apparatus between the slips and the top of the wellhead such as the top of BOP, secures and moves the slips with respect to well center as defined by the wellhead/BOP will improve the ease and safety with which the slips can be employed and positioned. The slips positioning apparatus is installed, and acts, between the slips and a rigid installation point on the wellhead. The apparatus, also referred to herein as a slips table, provides XY linear guides and releasable locks and/or drivers to position the slips relative to well center. The apparatus includes a slips-mounting structure for accepting connection of the slips, an installation structure for mounting the apparatus rigidly relative to well center and linear slidable guides and the releasable locks and/or drivers for positioning the slips-mounting structure, and thereby the slips, along the X and Y directions relative to the installation structure and substantially orthogonally relative to a center axis of the apparatus.

It has been determined that a linear actuator, such as an hydraulic cylinder or a screw drive, may function as both the releasable lock and the driver to both move and lock position of the slips table components along the linear slidable guides. Double acting hydraulic cylinders may be particularly useful.

Figure 1:
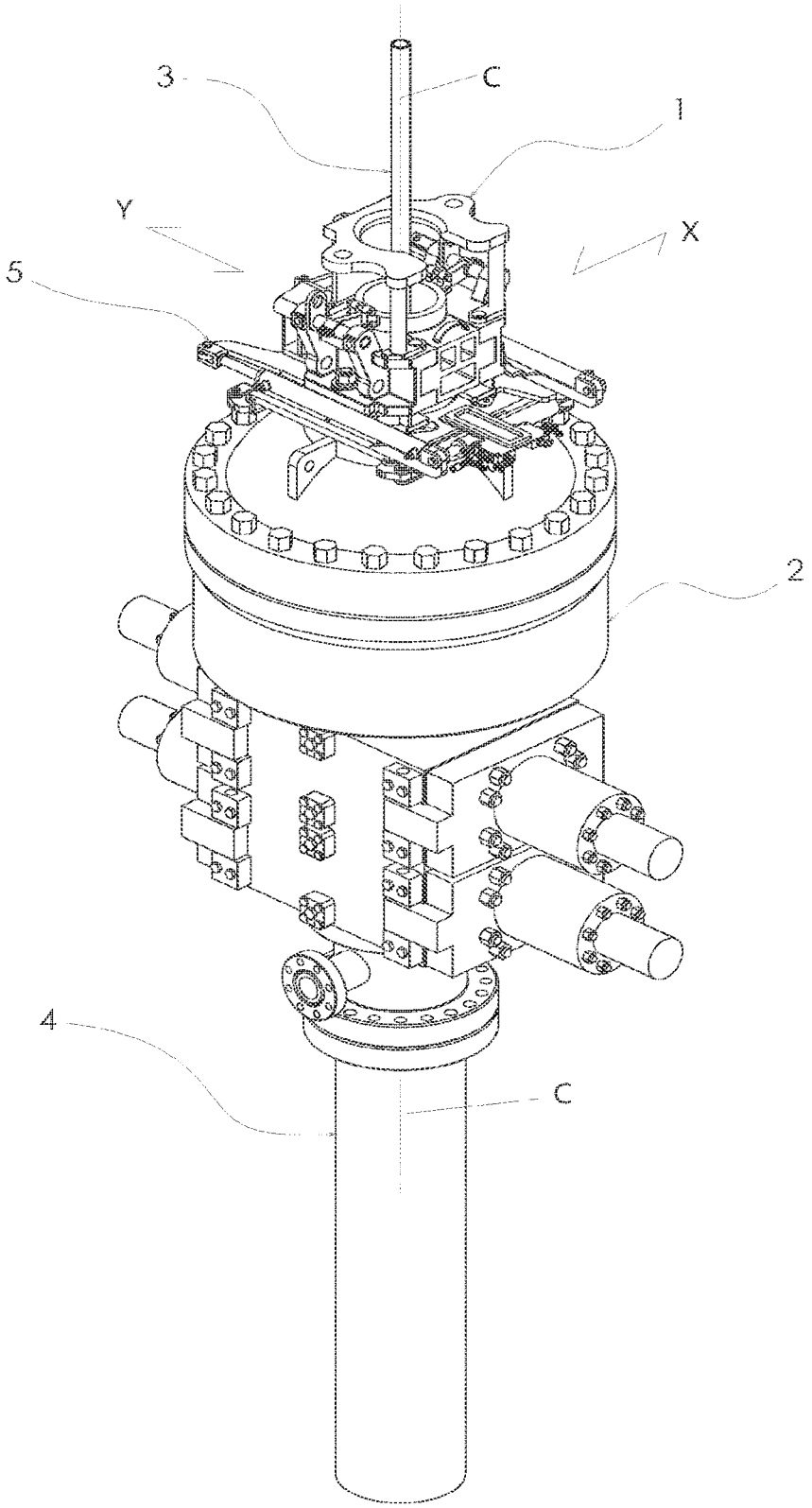
FIG. 1 is a top perspective view of a surface, wellhead set up during pipe string handling.

Referring to FIG. 1, a wellhead 4 is shown during an operation to handle a pipe string, herein a drill string 3. A BOP 2 is mounted to the wellhead. Slips 1 are coupled onto a slips positioning apparatus, herein called slips table 5, and the slips table is coupled to the top of the BOP 2. Slips 1 can be controllably moved along directions X and Y by slips table 5. Directions X and Y are two substantially perpendicular directions, each of which are substantially orthogonal relative to a center vertical axis through the slips table. The center vertical axis of the slips table can be aligned parallel with well center, defined in FIG. 1 as axis C.

Figure 2:
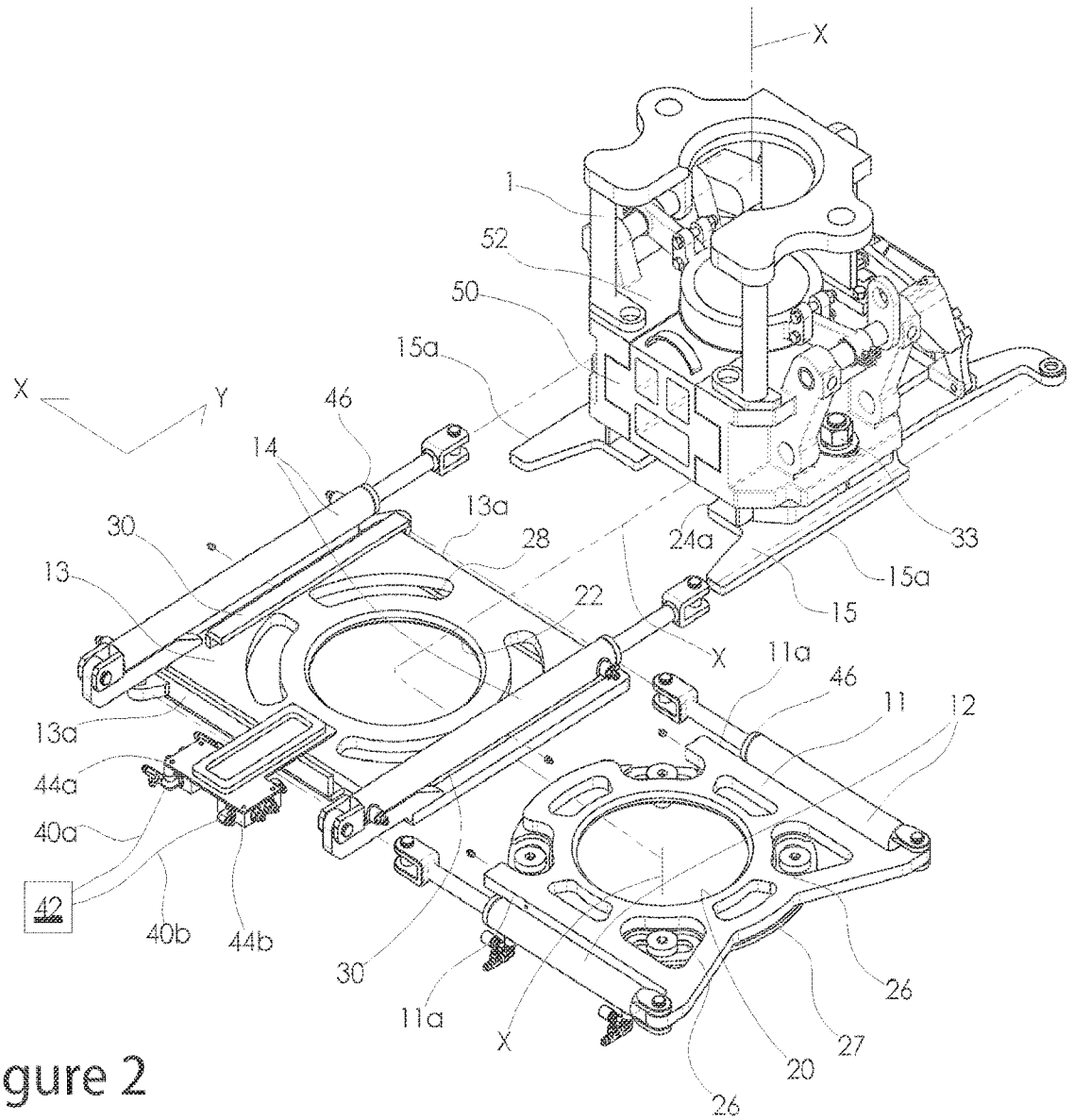
FIG. 2 is an exploded view of the of the slips positioning apparatus of FIG. 1 with the slips installed thereon.
Figure 3:
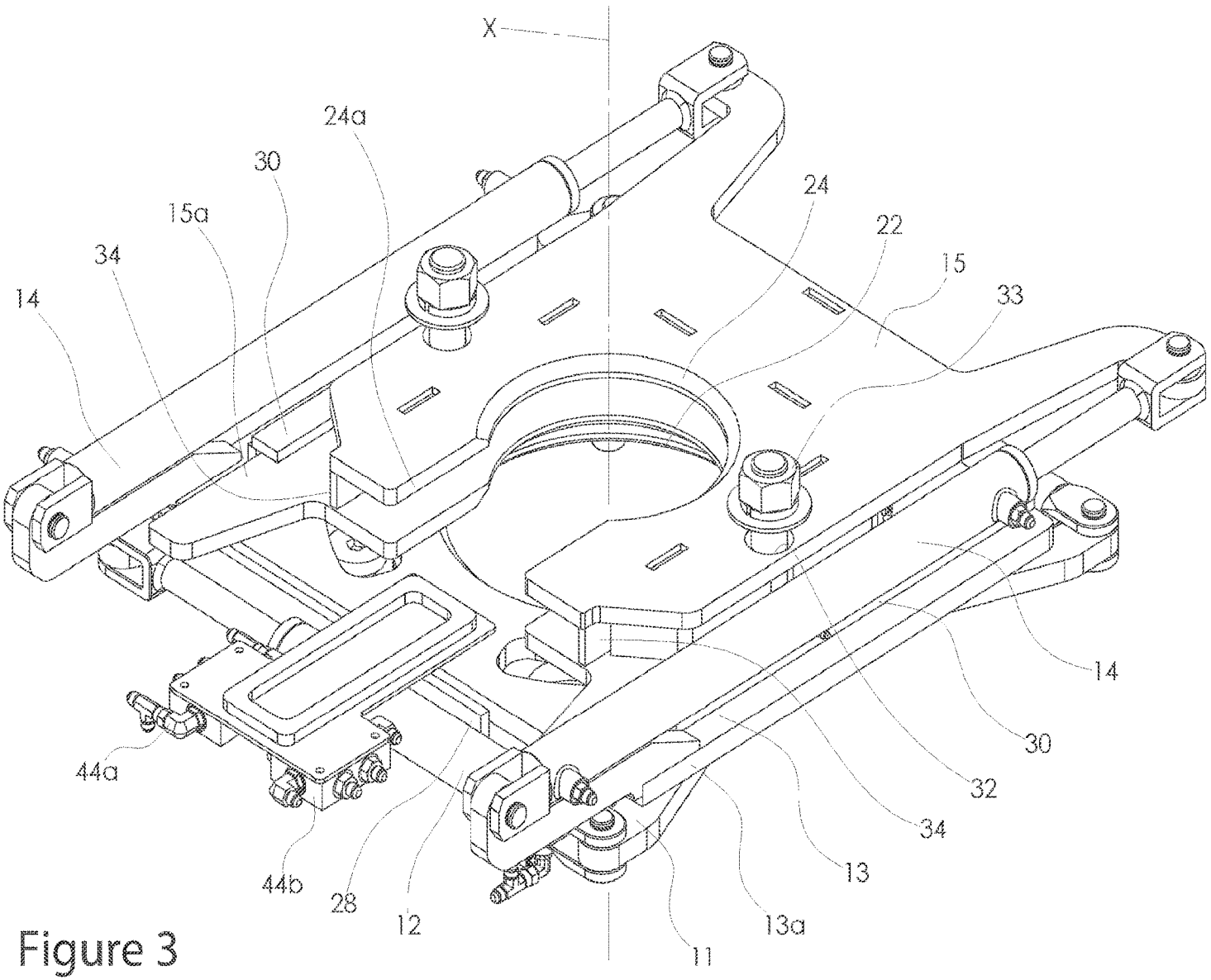
FIG. 3 is a top perspective view of the assembled slips positioning apparatus of FIG. 2 with the slips removed.

Referring also to FIGS. 2 and 3, the slips table apparatus 5 includes a base plate 11, X direction linear actuators 12, a center plate 13, Y direction linear actuators 14 and a top plate 15.

Each of the base plate, the center plate and the top plate include a central hole 20, 22, 24, respectively. Each central hole passes through its plate from top to bottom. As such, the plates each have perimeter side edges 11*a*, 13*a*, 15*a* surrounding the central holes. Perimeter side edges need not be continuous, as shown by plate 15, wherein the central hole 24 extends to a side edge. In particular, one side of the plate has a passage 24*a* connecting to the central hole 24.

Base plate 11 is configured, as by bolt apertures 26, for rigidly mounting on the surface structure above the BOP 2, such as on the BOP's uppermost end. Base plate 11 can be coupled to the surface structure with its central opening 20 centered on well center, for example with its central opening substantially concentrically positioned relative to the upper opening of BOP 2. For example, the base plate may have a pattern of apertures 26 to work with the BOP flange. For example, there may be four slotted apertures 26 that are concentric with a center point of hole 20. This arrangement may be equi-radial with the pattern on the top of the BOP, which generally matches a standard oilfield pipe connection flange bolt pattern. There are standard connection flange bolt patterns for different pipe diameters and pressure ratings. The base plate may be configured for the particular flange bolt pattern of the wellhead on which it is to be used. Apertures 26 in the base plate may be slotted to allow for some adjustment, such as rotational adjustment of the slips table during installation.

While the slips table 5 is typically installed on the upper end of the BOP, the slips table could be installed on a casing flange, if there is no BOP, or on the rig floor.

In one embodiment, base plate 11 includes a pedestal 27 in which bolt apertures 26 are positioned. Pedestal 27 is on the underside of base plate 11 such that edges 11*a* protrude laterally beyond, and are slightly raised above, pedestal 27.

Top plate 15 is configured, as by provision of holes 32 and/or hardware such as bolts or studs 33 to accept installation of the slips 1. The selection and arrangement of holes/hardware may vary depending on the type of slips to be employed. The central hole 24 may have a diameter to at least match the opening diameter of the slips, which will be selected based on the well and string sizes of the operation.

In one embodiment, top plate 15 includes a pedestal 34 on which studs 33 are positioned. Pedestal 34 extends upwardly on the upper side of the top plate such that edges 15*a* protrude laterally beyond and below pedestal 34. Pedestal 34 spaces the underside of slips 1 out of the way of plate 15 riding in rails 30.

Center plate 13 is sandwiched between top plate 15 and base plate 11. Center plate 13 defines at least a part of the linear guides, such as slide bearings. Linear actuators 12, 14 allow driven movement of the top plate relative to the base plate along x and y-axis orthogonal to the center axis x, which may be installed in alignment with the well center axis C.

Center plate 13 is configured for slidably coupling to base plate 11. In particular, center plate 13 is coupled to base plate 11 but there is a connection, such as rails 28, between center plate 13 and base plate 11 that permit the center plate to move relative to the base plate. For example, in the illustrated embodiment there are rails on the underside of center plate 13 that engage slidingly on the side edges of base plate 11. The rails may be formed by a pair of facing returns spaced apart a distance just slightly more than the width of the base plate and with a height such that the thickness of the base plate is retained between the returns and the underside of the center plate. The movement of center plate is substantially along a plane parallel with a plane defined along the expanse of the upper surface of the base plate. Rails 28 allow translation of center plate 13 relative to the base plate while holding the plates against separating in the Z direction. Stops may be provided to limit the range of motion and thereby to prevent overextension.

Movement of center plate 13 relative to the base plate may be driven by linear actuators 12, such as hydraulic cylinders. There may be a pair of linear actuators positioned symmetrically relative to plate 11 to permit smooth operation. Each linear actuator 12 may be connected at one end to base plate 11 and at its opposite end to the center plate. The linear actuators 12 drive center plate 13 slidingly over base plate 11.

Top plate 15 is configured for slidably coupling to center plate 13. In particular, center plate 13 and top plate 15 are coupled and there is a slidably moveable connection, such as rails 30, between center plate 13 and top plate 15 that permit the top plate to move relative to the center plate. The movement is substantially along a plane parallel with a plane defined along the expanse of the upper surface of the center plate.

In the illustrated embodiment, for example, rails 30 are on the upper side of center plate 13. Rails 30 engage slidingly on the side edges 15*a* of top plate 15. The rails may be formed by a pair of facing returns spaced apart a distance just slightly more than the width of the top plate and with a height such that the thickness of the top plate is retained between the returns and the upper side of the center plate. Rails 30 allow translation of top plate 15 relative to center plate 13 while holding the plates against separating in the Z direction. Stops may be provided to limit the range of motion and thereby to prevent overextension.

Movement of top plate 15 relative to the center plate along rails 30 may be driven by linear actuators 14, such as hydraulic cylinders as shown. There may be a pair of linear actuators 14 positioned substantially symmetrically relative to plate 15 to permit smooth sliding movement. Linear actuators 14 may be connected at one end to top plate and at their opposite end to the center plate to drive top plate slidingly over center plate.

In the assembly table, rails 28 are oriented substantially orthogonally to rails 30 such that motion therefrom is in two substantially perpendicular directions.

Actuators 12 and 14 are each in communication 40*a*, 40*b* with an actuator control system 42. The pairs of actuators can thereby be controlled by an operator to move the slips table along the X and/or Y-axis. In the illustrated embodiment, communications 40*a*, 40*b* are through hydraulic lines (not shown) and manifolds 44*a*, 44*b* are provided for supporting connection of the hydraulic lines between actuators 12 and 14 and a main hydraulic supply controlled by actuator control system 42.

In use, the base plate 11 is mounted in a fixed position relative to the BOP 2 with well center axis C passing up through hole 20. For example, the base plate 11 may be rigidly fixed to the top of the BOP with hole 20 concentrically oriented relative to the BOP top opening.

The center plate 13 is installed over base plate 11 with rails 28 fitting over the edges 11*a* of base plate 11. This locks the center plate to the base plate against movement in all axis except the X direction. In particular, the center plate is free to slide with respect to the base plate along direction X. Linear actuators 12 are connected between the base plate and the center plate to impart a drive force to the center plate to move in the X direction.

The slips 1 are rigidly fixed to the top plate 15. The top plate is installed over center plate 13 with side edges 15*a* slidingly engaged within rails 30. The rails lock the top plate to the center plate in all axis except the Y direction such that the top plate is free to slide with respect to the center plate along the Y direction. Linear actuators 14 are connected between the top plate and the center plate to impart force to move the top plate along rails 30 in the Y direction.

As the base plate, center plate and top plate are all furnished with a central hole, the drill string can pass through the whole assembly. These holes have a diameter at least as large as the size of the BOP opening or wellbore inner diameter. This is typically 7⅛" to 13⅝" in land based well service applications. Holes 20, 22, 24, therefore, are large enough and the range of motion of the linear actuators is large enough so that the drill string can be moved to any location within the well bore inner diameter without contacting the slips table apparatus. Instead, the motion of the drill string is constrained only by the inner diameter of the well bore. The cylinders may be sized with a stroke length appropriate to retain engagement of the plates. In other words, the cylinder stoke lengths may be selected to avoid driving the plates too far, such that the plates remain engaged with each other.

In one embodiment, linear position sensors, such as transducers 46, are provided to permit position sensing and to enhance automation options for the cylinder control.

By driving actuators 12, 14, the slips can be moved in any combination of the X and Y directions even while the drill string 3 is installed in the well and passing through slips 1. Actuators 12 may be driven independently of actuators 14. Once positioned, the actuators may be lockable such that once stroked to position slips 1, they may lock the position of the slips relative to well center. Slip positioning apparatus, therefore, may be useful in a slant rig operation, where well center is off vertical. All driving operations may be conducted remote from the slips, which offers reduces risk of injury to personnel. With transducers 46 providing positional feedback, the location of the slips relative to the well center can be determined remotely as well.

Figure 4:
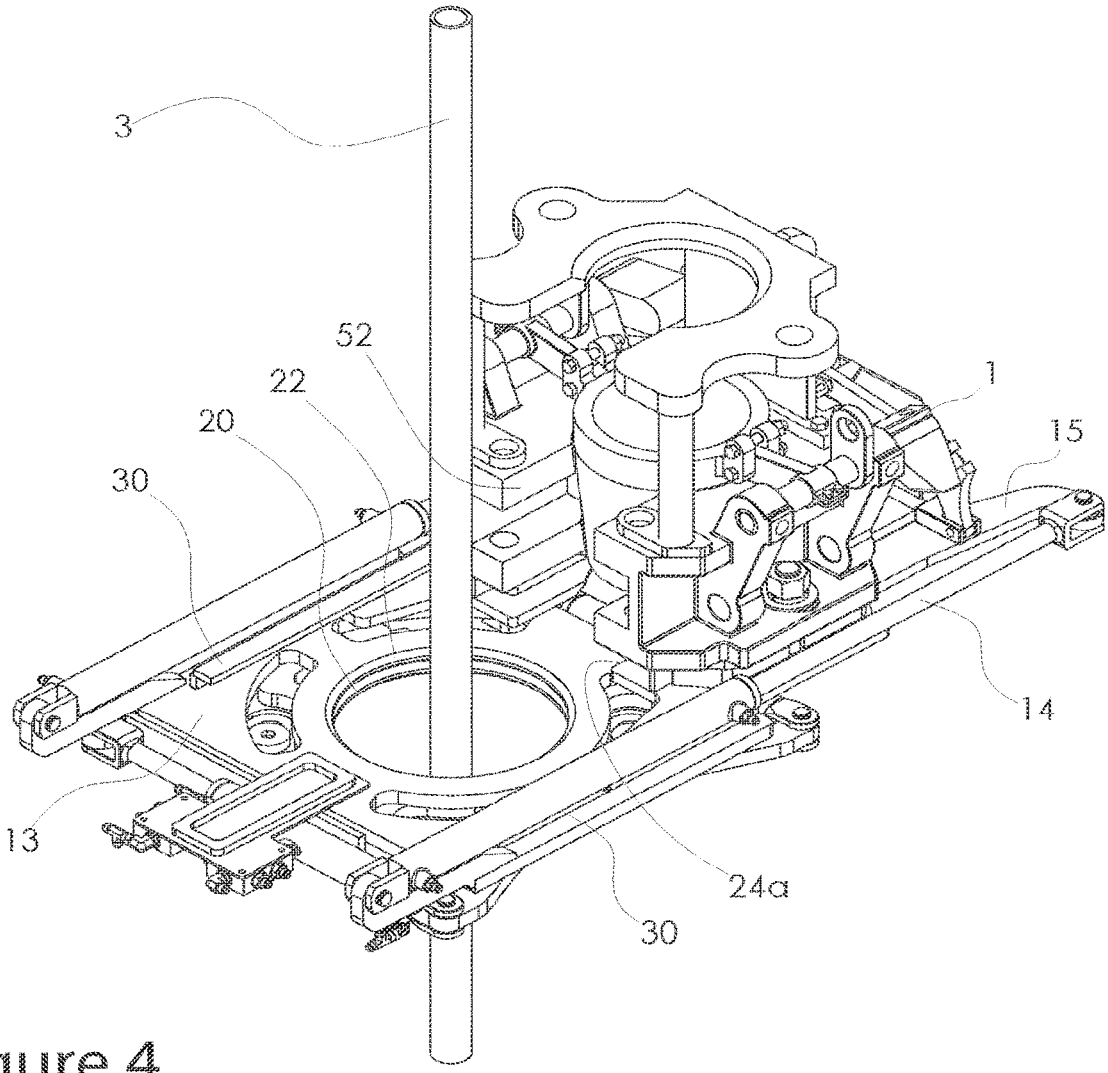
FIG. 4 is a top perspective view of the slips positioning apparatus of FIG. 2 with the slips moved back away from well center.

The stroke lengths of actuators 12, 14 may be similar or dissimilar, depending on the range of motion desired. It is desirable in some situations, for example, to be capable of fully removing the slips off the drill string. To allow for this to occur, the Y direction linear actuators 14 are furnished with a stroke long enough to move plate 15 entirely out of overlapping position with hole 20 and side edges 15*a* and/or rails 30 are long enough to accommodate this range of motion, while retaining plate 15 engaged by plate 13. This allows the slips to be fully pushed off and laterally away from the drill string, as shown in FIG. 4, once slip gate 50 is removed from its receptacle in slip bowl 52. In particular, once slip gate 50 is removed, the actuators 14 can drive plate 15 along the Y direction such that the plate hole 24 and passage 24*a* move past and away from opening 22 and drill string 3. This carries slips 1 laterally away from the drill string into a parked position. Control system 42 can have a function to prevent the actuators 14 from driving the plate 15 when the slips are engaged on a drill string.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A slips positioning apparatus for installing slips relative to a well center, the slips positioning apparatus comprising:

a slips-mounting structure for accepting connection of the slips;

an installation structure for mounting the apparatus rigidly relative to the well center, the installation structure having an upper surface defining a first plane;

a first linear guide positioned between the slips-mounting structure and the installation structure, the first linear guide configured for movement of the slips-mounting structure relative to the installation structure along a first direction in a plane substantially parallel with the first plane;

a second linear guide positioned between the slips-mounting structure and the installation structure, the second linear guide, configured for movement of the slips-mounting structure relative to the installation structure along a second direction in a plane substantially parallel with the first plane;

a first linear actuator for positioning the slips-mounting structure along the first linear guide; and, a second linear actuator for positioning the slips-mounting structure along the second guide.

2. The slips positioning apparatus of claim 1 wherein the first direction is an X direction and the second direction is a Y direction substantially perpendicular to the X direction.

3. The slips positioning apparatus of claim 1 wherein the first linear actuator includes a first pair of hydraulic cylinders and the second linear actuator includes a second pair of hydraulic cylinders.

4. A wellhead installation comprising:

a blowout preventer;

a positioning apparatus for slips, the positioning apparatus installed in a fixed position relative to the blow out preventer, the positioning apparatus comprising:

a slips-mounting structure for accepting connection of the slips;

an installation structure for mounting the positioning apparatus rigidly on a structure at a wellhead, the installation structure having an upper surface defining a first plane;

a first linear guide positioned between the slips-mounting structure and the installation structure, the first linear guide configured for movement of the slips-mounting structure relative to the installation structure along a first direction in a plane substantially parallel with the first plane;

a second linear guide positioned between the slips-mounting structure and the installation structure, the second linear guide configured for movement of the slips-mounting structure relative to the installation structure along a second direction in a plane substantially parallel with the first plane;

a first linear actuator for moving the slips-mounting structure along the first linear guide;

and a second linear actuator for moving the slips-mounting stricture along the second guide; and slips mounted on the slips-mounting structure.

5. The wellhead installation of claim 4 wherein the blow out preventer defines a well center axis and the first plane is orthogonal to the well center axis, the first direction is an X direction and the second direction is a Y direction substantially perpendicular to the X direction.

6. The wellhead installation of claim 4 wherein the first linear actuator includes a first pair of hydraulic cylinders and the second linear actuator includes a second pair of hydraulic cylinders.

7. A method for positioning slips relative to a well center of a wellbore, the method comprising:

operating a positioning apparatus for the slips including:

a slips-mounting stricture for accepting connection of the slips;

an installation structure for mounting the positioning apparatus rigidly relative to the well center, the installation structure having an upper surface defining a first plane;

a first linear guide positioned between the slips-mounting structure and the installation structure, the first linear guide configured for movement. of the slips-mounting structure relative to the installation structure along a first direction in a plane substantially parallel with the first plane;

a second linear guide positioned between the slips-mounting structure and the installation structure, the first linear guide configured for movement of the slips-mounting structure relative to the installation structure along a second direction in a plane substantially parallel with the first plane;

a first linear actuator for moving the slips-mounting structure along the first linear guide; and, a second linear actuator for moving the slips-mounting structure along the second guide; and actuating the first linear actuator to position the slips along the first direction.

8. The method for positioning as in claim 7 further comprising installing the positioning apparatus on a top opening of a blowout preventer.

9. The method for positioning as in claim 7 further comprising actuating the second linear actuator to position the slips along the second direction.

10. The method for positioning as in claim 9 wherein actuating the second linear actuator moves the slips-mounting structure and the slips away from the well center and out of alignment with the wellbore.

11. The method for positioning as in claim 7 wherein actuating moves both the slips and a drill string that is engaged by the slips.

12. The method for positioning as in claim 7 wherein actuating drives movement of the slips by an operator positioned remote from the slips.

* * * * *